US008602238B2

(12) United States Patent
El-Saden et al.

(10) Patent No.: US 8,602,238 B2
(45) Date of Patent: Dec. 10, 2013

(54) DRINK BOTTLE

(75) Inventors: Sami El-Saden, Winnetka, IL (US); Blair E. Miller, Chicago, IL (US); Daniel M. Wodka, Chicago, IL (US); John W. Phillips, Hunington Beach, CA (US)

(73) Assignee: Ignite USA, LLC, Chicago, IL (US)

( * ) Notice: Subject to any disclaimer, the term of this patent is extended or adjusted under 35 U.S.C. 154(b) by 0 days.

(21) Appl. No.: 13/359,178

(22) Filed: Jan. 26, 2012

(65) Prior Publication Data

US 2012/0187075 A1 Jul. 26, 2012

Related U.S. Application Data

(60) Provisional application No. 61/436,474, filed on Jan. 26, 2011.

(51) Int. Cl.
*B65D 83/00* (2006.01)

(52) U.S. Cl.
USPC ..... 215/389; 20/707; 20/259.1; 20/831

(58) Field of Classification Search
USPC ..... 215/389, 388, 387; 220/703, 709, 708, 220/707, 706, 705, 254.9, 254.6, 259.1, 220/259.2, 831
See application file for complete search history.

(56) References Cited

U.S. PATENT DOCUMENTS

| | | | | |
|---|---|---|---|---|
| 3,881,643 | A * | 5/1975 | LaVange | 222/505 |
| 5,137,168 | A | 8/1992 | Mothrath et al. | |
| 5,203,468 | A | 4/1993 | Hsu | |
| 5,332,131 | A * | 7/1994 | Pehr | 222/505 |
| 5,409,131 | A * | 4/1995 | Phillips et al. | 220/717 |
| 5,427,271 | A | 6/1995 | Wang | |
| 6,116,458 | A | 9/2000 | Dark | |
| 6,279,773 | B1 | 8/2001 | Kiyota | |
| 6,523,711 | B1 | 2/2003 | Hughes et al. | |
| 6,609,624 | B2 * | 8/2003 | Goto et al. | 220/259.1 |
| 7,059,490 | B2 * | 6/2006 | Son | 220/254.3 |
| D533,061 | S | 12/2006 | Li | |
| D547,607 | S | 7/2007 | Forsman | |
| D592,913 | S | 5/2009 | Pinelli et al. | |
| 7,533,783 | B2 | 5/2009 | Choi et al. | |
| 7,708,035 | B2 | 5/2010 | Windmiller | |
| 7,766,057 | B2 | 8/2010 | Windmiller | |
| D626,838 | S | 11/2010 | Meyers et al. | |
| D634,161 | S | 3/2011 | Roth et al. | |
| 2002/0036207 | A1 | 3/2002 | Ohuo et al. | |
| 2003/0102318 | A1 * | 6/2003 | Lee | 220/705 |
| 2004/0069783 | A1 | 4/2004 | Chen | |
| 2007/0039959 | A1 | 2/2007 | Choi et al. | |
| 2008/0237233 | A1 * | 10/2008 | Choi et al. | 220/212.5 |
| 2008/0272134 | A1 | 11/2008 | Rohe | |
| 2010/0181329 | A1 | 7/2010 | Davies et al. | |

OTHER PUBLICATIONS

International Search Report and Written Opinion issued in connection with PCT/US2012/022769, dated May 11, 2012. 7 pages.
Photos of beverage container obtained from Starbucks Coffee, on or about Nov. 2011.

* cited by examiner

*Primary Examiner* — Anthony Stashick
*Assistant Examiner* — Christopher McKinley
(74) *Attorney, Agent, or Firm* — Vedder Price P.C.

(57) ABSTRACT

A drink bottle may include a container and a lid connected to the container. The lid may include a spout and a spout cover. Each of the spout and the spout cover may be moved in opposite directions between a stowed configuration and a dispensing configuration.

18 Claims, 7 Drawing Sheets

DRINK BOTTLE

RELATED APPLICATIONS

This application is a non-provisional patent application that claims the benefit of and the priority from U.S. Provisional Patent Application No. 61/436,474, filed Jan. 26, 2011, titled DRINK BOTTLE.

FIELD OF THE DISCLOSURE

The present disclosure relates generally to drink bottles, and more particularly, to drink bottles with a spout protected in a cocoon in a stowed configuration and a freely movable spout in a dispensing configuration.

BACKGROUND

Many conventional drink bottles fail to protect the spout from damage and/or contamination when in a stowed or non-use configuration. Additionally, conventional drink bottles may also have complex valve or covering mechanisms necessary to manipulate in order to dispense the fluid in the container. Accordingly, there is a need in the art for a drink bottle that overcomes the disadvantages of the prior art.

BRIEF DESCRIPTION OF THE DRAWINGS

The following disclosure as a whole may be best understood by reference to the provided detailed description when read in conjunction with the accompanying drawings, drawing description, abstract, background, field of the disclosure, and associated headings. Identical reference numerals when found on different figures identify the same elements or a functionally equivalent element. The elements listed in the abstract are not referenced but nevertheless refer by association to the elements of the detailed description and associated disclosure.

DETAILED DESCRIPTION OF THE PREFERRED EMBODIMENTS

The present disclosure is not limited to the particular details of the apparatus depicted, and other modifications and applications may be contemplated. Further changes may be made in the apparatus, device or methods without departing from the true spirit of the scope of the disclosure herein involved. It is intended, therefore, that the subject matter in this disclosure should be interpreted as illustrative, not in a limiting sense.

In one aspect of the present disclosure, a drink bottle may include a container and a lid connected to the container. The lid may include a spout and a spout cover. Each of the spout and the spout cover may be moved in opposite directions between a stowed configuration and a dispensing configuration.

In another aspect of the present disclosure, the spout and spout cover may be connected to the lid at diametrically opposed positions.

In yet another aspect of the present disclosure, an actuator may be connected to the spout to facilitate movement of the spout between the stowed and dispensing configurations. The actuator may be a latch assembly selectively connected to the spout, a user input feature or other suitable device, apparatus, or the like, etc.

In a further aspect of the present disclosure the spout cover may be normally biased to the dispensing configuration. For example, a counterweight may be connected to an outer portion of the spout cover to orient a center of gravity of the spout cover offset from an axle of the spout cover or a spring element may include a first end contiguous with the spout cover and a second end contiguous with the lid.

In still yet another aspect of the present disclosure, the spout initiates movement of the spout cover from the stowed configuration in one embodiment and from the dispensing configuration in another or the same embodiment.

Figure 1:
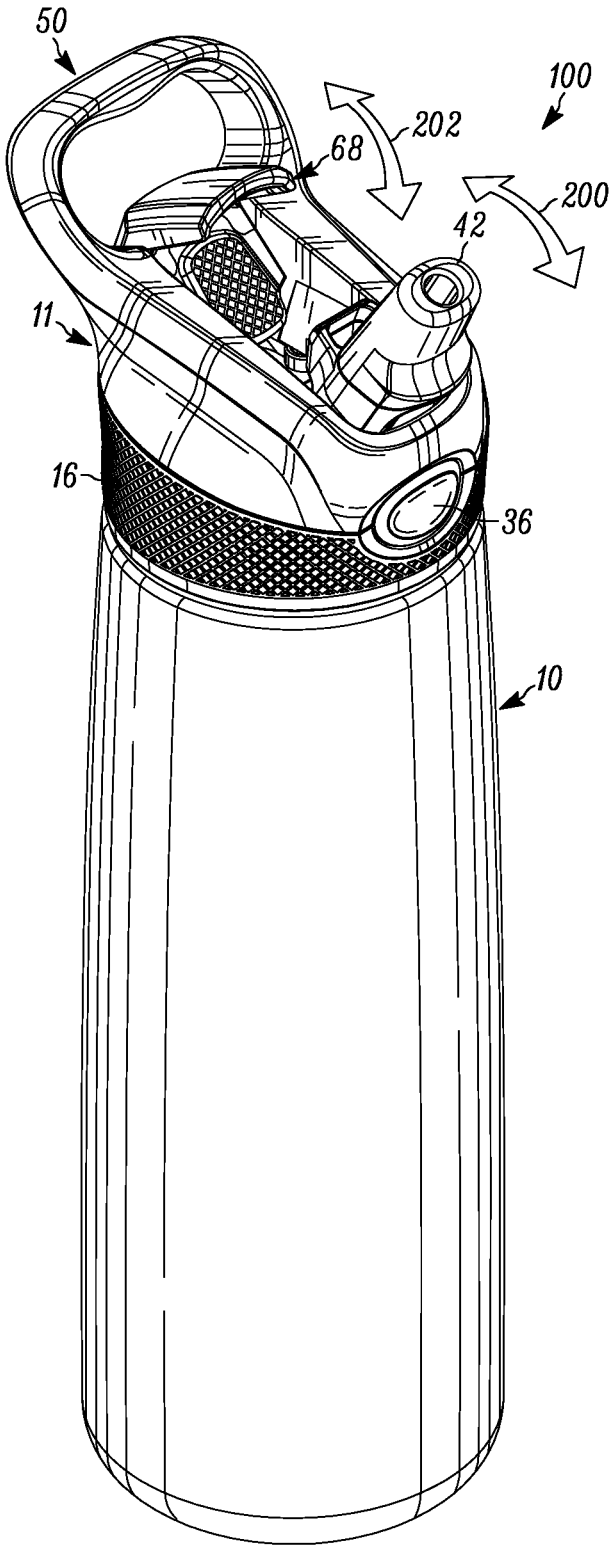
FIG. 1 is an elevation view of a drink bottle in accordance with one embodiment of the present disclosure.

FIG. 1 is an elevation view that illustrates a drink bottle 100 in accordance with one embodiment of the present disclosure that may include, in one embodiment, a container 10 and a lid 11 connected to the container 10. It will be recognized by those of skill in the art that each such component may be formed by single or multiple elements, separately or integrally formed. For example, the lid 11 may include a thread skirt 16, housing 50, an actuator 36 operatively associated with a spout 42, such as by direct, selective, removable, intermittent, or the like, etc. connection to the spout 42, and a spout cover 68, in one embodiment. In one embodiment, the spout 42 and the spout cover 68 may be movably connected to the lid 11 such that each of the spout 42 and the spout cover 68 are movable (e.g., pivotally, rotationally, or the like, etc.) in opposite directions, as illustrated by arrow 200 associated with the spout 42 and arrow 202 associated with spout cover 68, between a stowed or non-use configuration (see FIG. 4) and a dispensing or use configuration (see FIGS. 1-3), where a user may access a liquid within the container 10.

Figure 2:
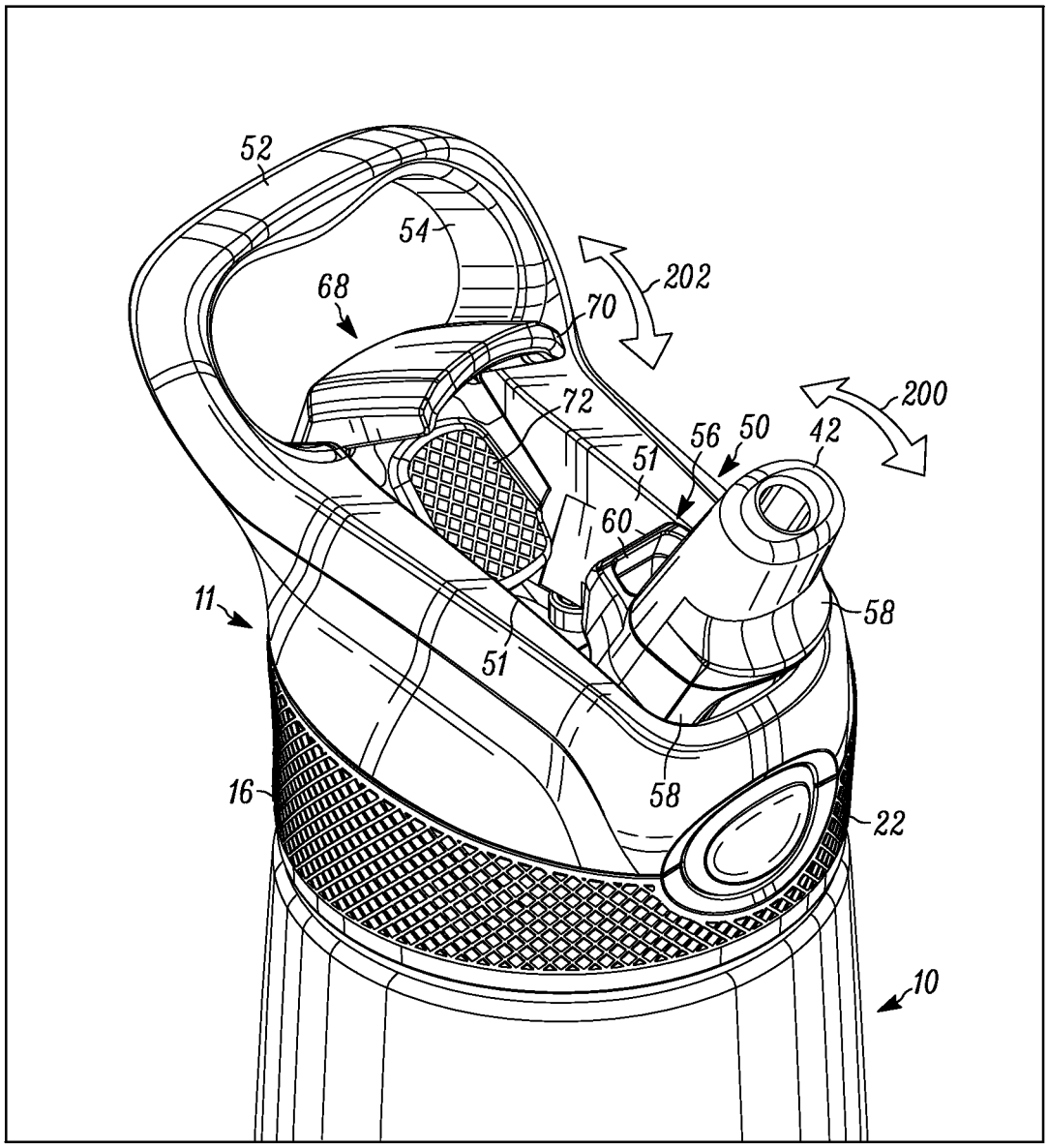
FIG. 2 is a perspective view of an upper portion of the drink bottle of FIG. 1.

FIG. 2 illustrates a close-up detailed view of an upper portion of the container 10 and the lid 11. The thread skirt 16 may include an over-molded grip portion 22 to facilitate installation and removal of the lid 11 with respect to the container 10 in any known conventional manner. It is within the teachings of the present disclosure that the grip portion 22 may be formed of any suitable material that enhances a users grip of the thread skirt 16. For example, the grip portion may be textured in a suitable pattern or may be constructed of a soft material so as to slightly compress when gripped by a user, etc. Additionally, the grip portion 22 is not required to be over-molded, but rather may be formed as a separate element that is fitted to the thread skirt 16 in a tight, interference-like manner during assembly. In one embodiment, the housing 50 may include a handle 52 that may have an over-molded grip portion 54 and side walls 51. It will be recognized by those of skill in the art that the handle 52 provides significant additional functionality and may have any suitable configuration. For example, one end of the handle 52 may be removably connected to the housing 50 so as to provide a selective connection functionality by disconnecting such end from the housing 50, flexing and placing the handle 52 around a desired structure, object, or the like, etc. and then reconnecting such end to the housing 50. Additionally, it is within the teachings of the present disclosure that the grip portion 54 may be likewise configured or constructed as the grip portion 22 in all material respects.

In one embodiment, a collar 56 may include a cover portion 58 and a catch portion 60 snap-fit connected to one another about the spout 42. Preferably, the collar 56 is movably connected to the housing 50 in any suitable manner, as one embodiment will be described below.

In one embodiment, the spout cover 68 may include a cover portion 70 and a flap 72, the spout cover 68 may be movably connected to the lid 11 or housing 50 at a position diametrically opposite or opposed to the collar 56 and spout 42.

Figure 3:
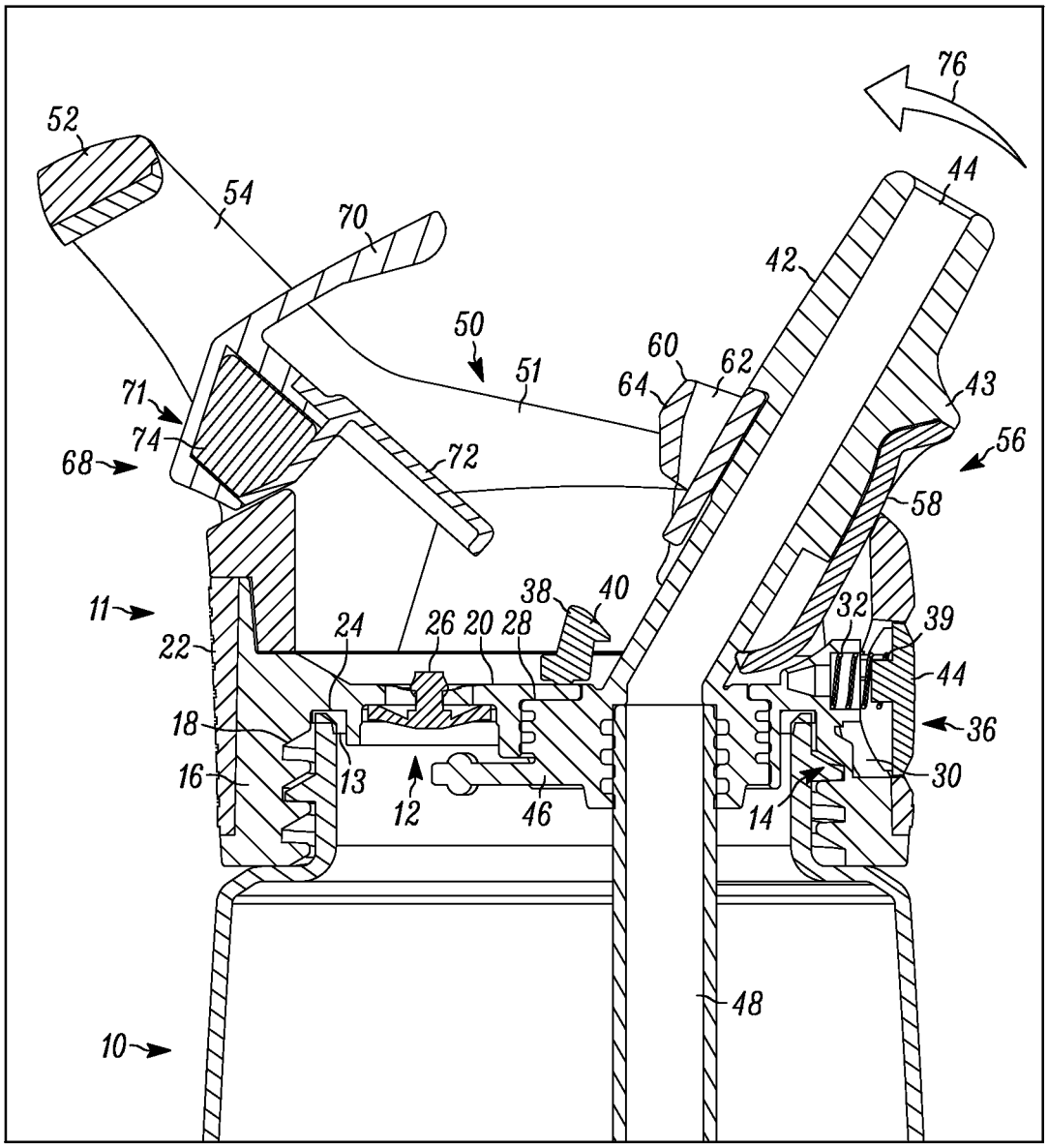
FIG. 3 is a cross-sectional view of the upper portion of FIG. 2 in a dispensing configuration.

FIG. 3 illustrates a cross-sectional view of the container 10 and lid 11 of the drink bottle 100. The container 10 may include an opening 12 and a threaded portion 14 disposed generally about the circumference of the opening 12. It is within the teachings of the present disclosure that the container 10 may be formed from any suitable material, such as, but not limited to, metal, plastic, synthetic, natural or any other suitable materials. Likewise, the container 10 may have any suitable configuration for the intended functionality.

Figure 4:
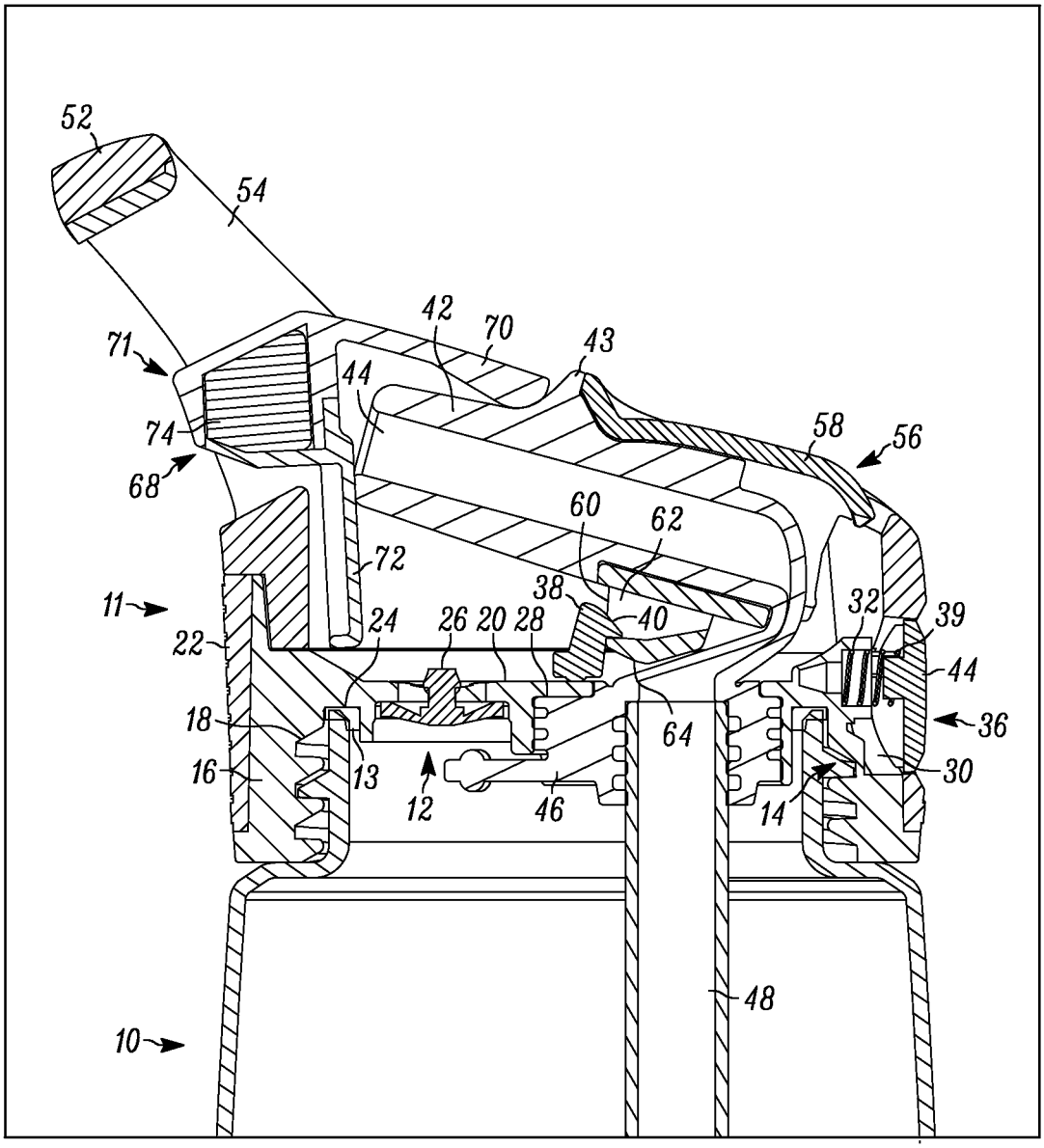
FIG. 4 is a cross-sectional view of the upper portion of FIG. 2 in a stowed configuration.

As shown in FIGS. 3 and 4, the thread skirt 16 may include a threaded portion 18 that is complementary to the threaded portion of 14 of the container 10 in order to facilitate connection of the lid 11 to the container 10 by relative rotation or other suitable connection protocol. In one embodiment, a main body seal 24 may be disposed on the thread skirt 16 so as to be aligned in registration with a rim 13 of the container 10 that defines the opening 12, such that when the lid 11 is installed on the container 10, the main body seal 24 contacts or engages the rim 13 sufficiently to form a seal to prevent liquid within the container 10 from exiting the container 10 from the thread skirt 16 and rim 13 interface. It is within the teachings of the present disclosure that the main body seal 24 may have any suitable configuration or composition, such as, for example, any rubber, plastic, natural or synthetic material, or the like, etc. satisfactory to provide the intended functionality. The grip portion 22 preferably extends about a circumference of the thread skirt 16 as an over-molded element having a softer or lower durometer than the main portion of the thread skirt in order to facilitate increased grip of a user in connection with installing and removing the lid 11 from the container 10. In one embodiment, the thread skirt 16 includes a cover portion 20 disposed adjacent, contiguous and within the threaded portion 18 that may include a vent seal 26 and a spout boss 28. In one embodiment, the vent seal 26 is a movable membrane that facilitates equalization of the pressures outside the container 10 and inside the container 10, yet is configured such that as normally disposed it will not allow liquid within the container 10 to exit the vent.

As shown in FIGS. 3 and 4, the spout 42 may include a passageway 44 defined by an interior wall and a mounting portion 46 disposed at a proximate end opposite the dispensing end. It is within the teaching of the present disclosure that the spout 42 may be formed of any suitable material, such as, but not limited to, silicone, rubber, synthetic, natural or any other suitable materials, or the like, etc. In one embodiment, the mounting portion 46 may include an enlarged portion having an outside diameter configured to sealingly engage the spout boss 28 to sufficiently secure the spout 42 to the cover 20 and prevent the leakage of liquid from within the container 10, and an inner diameter configured to engage a straw 48 that is useful for drawing the liquid from a lower portion of the container 10, as will be recognized by one of ordinary skill in the art. The passageway 44 may extend from a proximate portion adjacent the inner diameter to a distal portion near the tip or an dispensing end of the spout 42 so as to communicate therethrough with the straw 48 to provide a continuous unrestricted conduit for the liquid within the container 10 to be withdrawn by a user without the activation of any valve or dispensing limiting mechanism, when the spout 42 is disposed in the dispensing or use configuration. Preferably, in one embodiment, the spout 42 is freely movable in the dispensing configuration such that only the housing 50 contacts the collar 56 to define a maximum open position, and only the flap 72 contacts the spout 42 to define a minimum open position. Free, unrestricted movement of the spout 42 in the dispensing configuration is advantageous to the user as there is zero restriction in the straw 48 or spout 42 for extracting liquid from within the container 10.

As shown in FIGS. 3 and 4, the lid 11 or thread skirt 16 may also include an actuator assembly or user input feature 36 such as a button receptacle 30 and a biasing mount 32, each preferably cooperatively associated with a latch mechanism 34 that may include a hook 38, release button 36 and biasing element 39. In one embodiment, a boss 41 may be disposed on a backside of the release button 36 in order to orient the biasing element 39 for alignment and registration with the biasing mount 32. The hook 38 may include a cam lead-in surface 40 in one embodiment to facilitate movement of the release button against the biasing element 39 in order to facilitate engagement of the hook 38 in an interlocking manner with an opening 62 defined in a catch portion 60 of the collar 56. The actuator or user input feature facilitates movement of the spout 42 and the spout cover 68 between the stowed or non-use configuration and the dispensing configuration. In one embodiment, a user may press the release button 36 so that the hook 38 is disengaged from the opening 62. In response thereto, the potential tension or force stored by bending, stretching, or the like, etc. of the spout 42 may be released, causing the spout 42 to pivotally rotate about the axle in the direction toward the release button 36 (as shown by arrow 200). The spout cover 68, being normally biased to the dispensing configuration, as described herein, will automatically pivot about an associated pivot axle 66 (for example, see FIG. 5 detail) from the stowed configuration when the spout 42, engaging the flap 72 in the dispensing configuration, no longer engages the flap 72 in order to initiate movement of the spout cover 68 from the stowed configuration.

Figure 7:
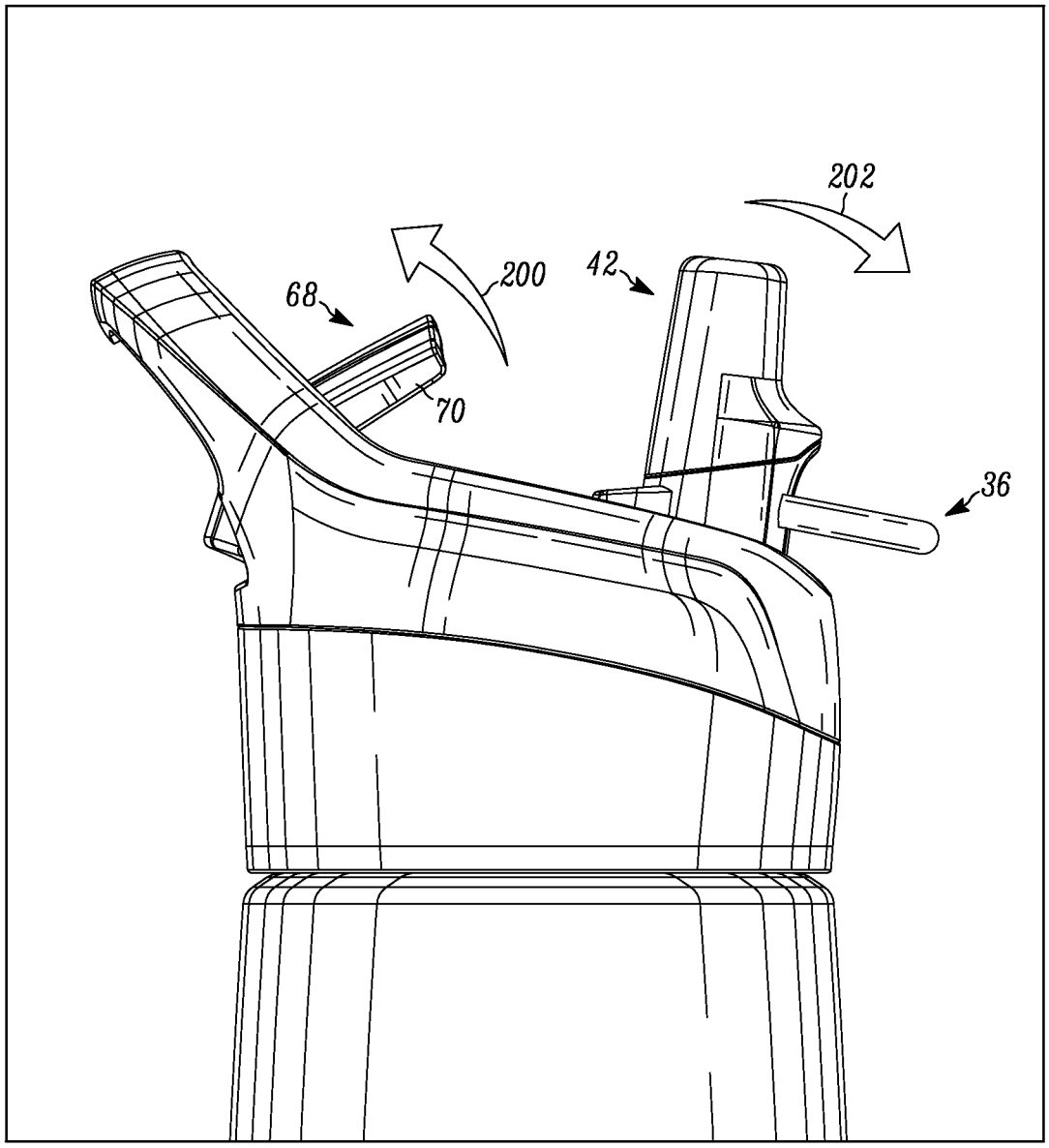
FIG. 7 is another embodiment of the upper portion of the drink bottle of FIG. 1.

In another embodiment, as shown in FIG. 7, the user input feature 36 may be configured as a structural component that facilitates manual movement of the spout 42 between the stowed or non-use configuration and the dispensing or use configuration. For example, the user input feature 36 may be a handle, a knob, a bump, a grip area, a tab, extension, projection, or the like, etc. Other components of the drink bottle 100 may be likewise configured for identical function as otherwise described herein.

Figure 5:
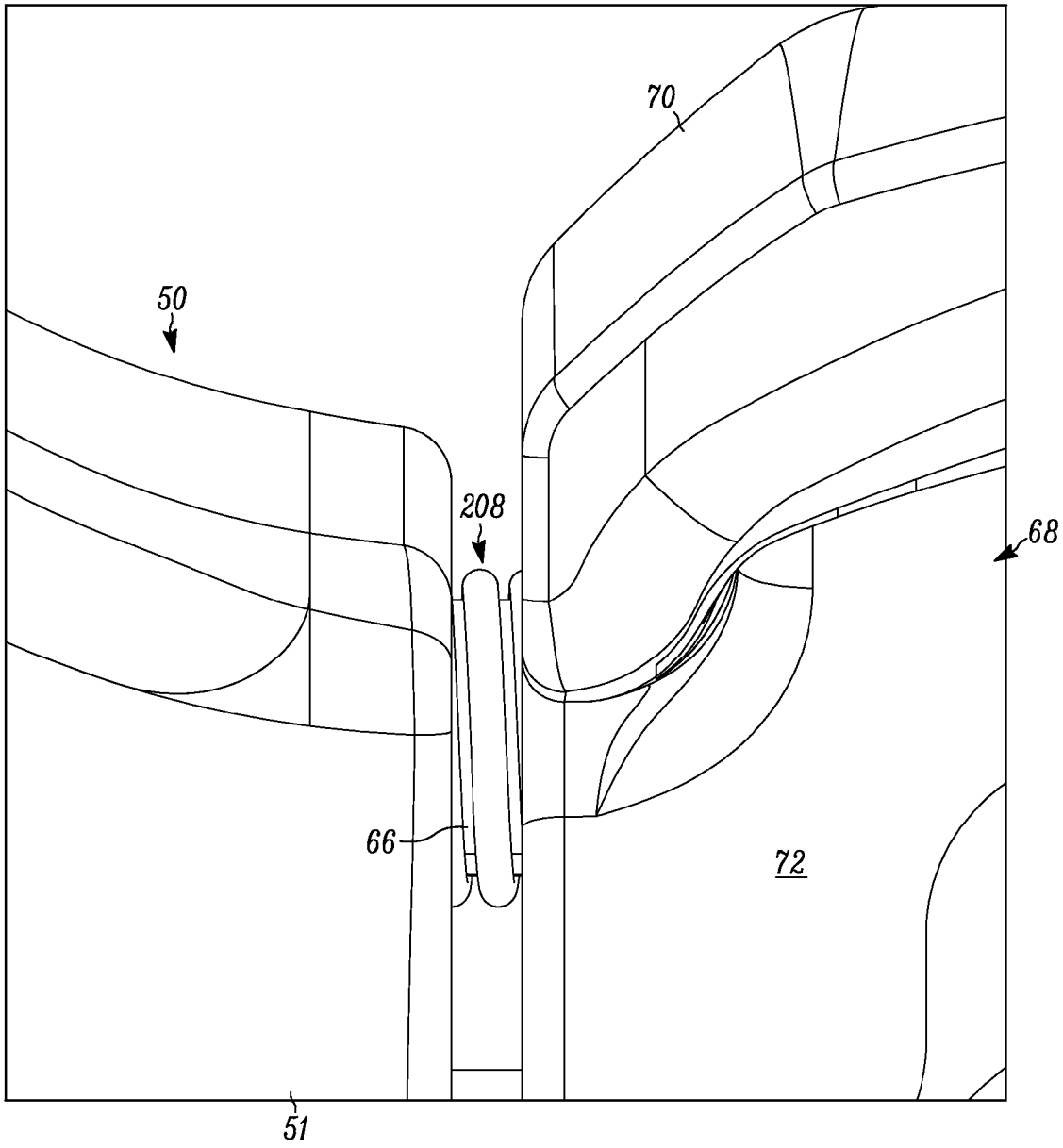
FIG. 5 is a detailed perspective view of another embodiment of a cover portion of the drink bottle of FIG. 1.

As shown in FIGS. 3 and 4, the collar 56 may include a cover portion 58 that is snap-fit connected to the catch portion 60 to surround the spout 42 and facilitate movable connection of the collar 42 to the housing 50 by an axle (e.g., similar to the pivot axle 66 as shown in FIG. 5 to provide the intended functionality) that extends from the collar 56. It is within the teachings of the present disclosure that the cover portion 58 and catch portion 60 are preferably disposed closely proximate and most preferably in contact with an exterior surface of the spout 42. In one embodiment, the cover portion 58 extends from a position adjacent the proximal end of the spout near the spout boss 28 or mounting portion 46 to an intermediate protrusion 43 of the spout 42 in order to provide a protective cover for the lower portion of the spout 42 when disposed in the stowed configuration (see FIG. 4). Preferably, the spout 42 may be configured to include shoulders on opposite sides that generally correspond to the cover portion 58 and the catch portion 60 of the collar 56 in order to engage the upper distal ends of the collar 56 so that the collar 56, when moved in the direction of arrow 76, will stretch and crimp the passageway 44 (see FIG. 4), rather than permitting the spout 42 to withdraw with respect to the collar 56.

In one embodiment, the catch portion 60 may include a cam lead-in surface 64 and a pivot axle. It will be recognized that engagement of the cam lead-in surface 40 with the cam lead-in surface 64 when the spout 42 is moved in the direction of arrow 76 to orient the lid 11 and drink bottle 100 from a dispensing configuration (as shown in FIGS. 1-3 to a stowed configuration as shown in FIG. 4). It is within the teachings of the present disclosure that the pivot axle may be configured in any suitable manner as described and shown herein and disposed on the catch portion 60 or the cover portion 58 of the collar 56 in order to provide the intended functionality. Preferably, the pivot axle is configured in one embodiment as projections from opposite sides of the catch portion 60 that are configured to engage and be received in appropriately configured mounting apertures in the housing 50 (similar to what is shown in FIG. 5, for example only).

As shown in FIGS. 3 and 4, the housing 50 may be connected to an upper portion of the thread skirt 16 opposite the threaded portion 18 to pivotally mount the collar 56 (and spout 42) and spout cover 68. In one embodiment, the housing 50 may include a handle 52 which may include an overmolded grip portion 54 that preferably has a softer or lowered durometer to facilitate comfort for a user when carrying or using the drink bottle 100.

Figure 6:
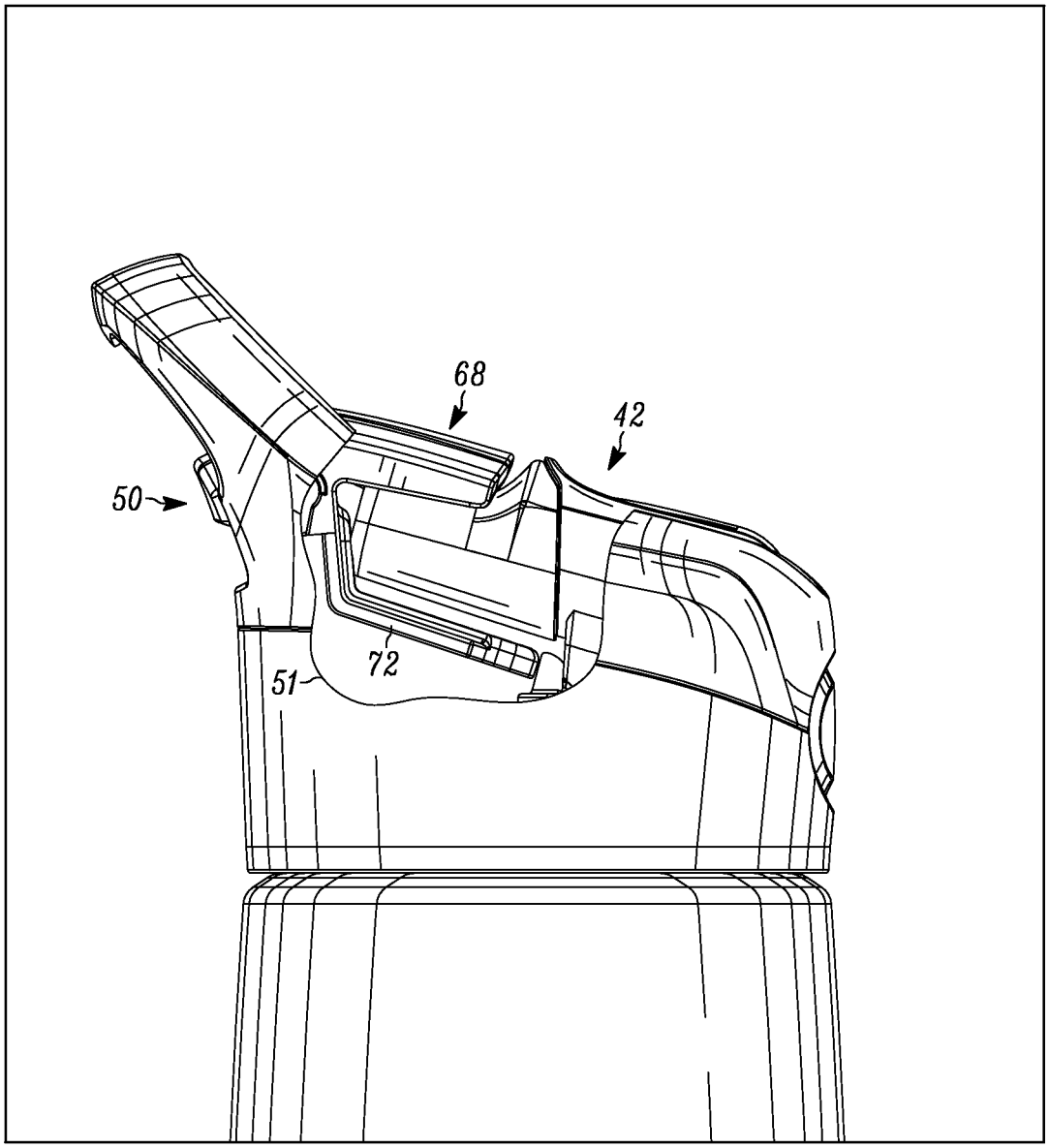
FIG. 6 is a partial cut-away side elevation view of another embodiment of the cover portion of the drink bottle of FIG. 1.

The spout cover 68 may include a cover portion 70, a flap 72 and an outer portion 71 that may include a counter-weight 74. Preferably, the counter-weight 74 may normally bias the spout cover 68 to the dispensing configuration in order to dispose the cover portion 70 in a raised position. The counter-weight 74 may be connected to the outer portion 71 of the spout cover 68 in such a manner so as to orient a center of gravity of the spout cover 68 offset from a pivot axle 66 of the spout cover. In one embodiment, the cover portion 70 is disposed on the housing 50 diametrically opposed to the collar 56. Alternatively, as shown in FIGS. 5 and 6, a spring element may include a first end contiguous with the spout cover and a second end contiguous with the lid 11, such as, for example, a torsion, leaf, or the like, etc. spring. FIG. 5 illustrates a torsion spring 208 disposed about a pivot axle 66 of the spout cover 68 such that a first end contact the spout cover and the second end contacts the lid 11. The spout 42 initiates movement of the spout cover 68 from the stowed configuration, whereupon each of the spout 42 and the spout cover pivotally rotate about positions diametrically opposed in different directions, and the torsion spring 208 applies the remaining necessary force to disposed the spout cover in the dispensing position after the spout 42 no longer engages the flap 72. The spout 42 initiates movement of the spout cover 68 from the dispensing configuration by engaging the flap 72 in order to overcome the force of the torsion spring 208. FIG. 6 illustrates a flap 72 constructed of a deformable material (such as, for example only, rubber, silicone, natural or synthetic materials, or the like, etc.) that naturally sits at a flat plane that is angled from the horizontal plane. When the spout 42 is moved into the stowed configuration, the spout 42 may interact with the deformable flap 72, which will be deformed downward along with the spout 42 and in the same process pull the cover portion 70 of the spout cover 68 around the pivot axle 66 to close on top of the spout 42. The resilience of the deformable flap 72 will cause the spout cover 68 to return to the fully open or dispensing configuration when the external force of the spout 42 is removed.

In another embodiment, as shown in FIG. 7, the user input feature 36 may be configured as a structural component that facilitates manual movement of the spout 42 between the stowed or non-use configuration and the dispensing or use configuration. For example, the user input feature 36 may be a handle, a grip area, a tab, extension, projection, or the like, etc. Other components of the drink bottle 100 may be likewise configured for identical function as otherwise described herein.

FIG. 4 illustrates a cross-sectional view of the drink bottle 100 wherein the lid 11 may be disposed in the stowed configuration. In this configuration, the spout 42 has been rotated about the pivot axle 66 of the collar 56 in the direction of arrow 76 until the distal end of the spout 42 contacts the flap 72 of the cover portion 70. Continued rotation of the spout 42 in direction 76 causes the spout cover 68 to move in the direction of arrow 78 against the normal bias of the spout cover 68 (such as, for example only, the counter-weight 74, torsion spring 208 or deformable flap 72, each of which normally causes the spout cover 68 to move in a direction opposite to that of arrow 78 and be disposed in the position as shown in FIGS. 1-3), such that when the hook 38 engages the opening 62 to secure the spout 42 in the stowed orientation, the cover portion 70 of the spout cover 68 is disposed over a portion of the spout 42 extending from the distal end to the intermediate protrusion 43. Accordingly, the combination of the cover portion 70 of the spout cover 68, the cover portion 58 of the collar 56 and the walls 51 of the housing 50 cooperate to define a "cocoon" to fully protect the spout 42, and in particular the tip of the spout 42, from dirt, debris, contamination or other damage that may occur, and to otherwise improve the hygiene with respect to use of a drink bottle 100.

The spout 42 when disposed as shown in FIG. 4 (i.e., the stowed or non-use configuration) is sealed against liquid discharge from the container because the proximate portion of the passageway 44 is kinked, crimped or bent back on itself much like closing a valve and thereby sealed such that there is no communication between the passageway 44 and the straw 48.

The preceding detailed description merely sets forth some examples and embodiments of the present disclosure and that numerous changes to the disclosed embodiments can be made in accordance with the disclosure herein without departing from its spirit or scope. The preceding description, therefore, is not meant to limit the scope of the disclosure but to provide sufficient disclosure to one of ordinary skill in the art to practice the invention without undue burden.

What is claimed is:

1. A drink bottle comprising:

a container;

a lid connected to the container, the lid including:

a spout and a spout cover, wherein each of the spout and the spout cover are movable in opposite directions between a stowed configuration and a dispensing configuration, and an actuator assembly movably connected to the lid, said actuator assembly operatively coupled to the spout when the spout is disposed in the stowed configuration such that the spout engages the spout cover to responsively retain the spout cover in the stowed configuration, and said actuator assembly selectively operatively uncoupled from the spout in order to facilitate movement of the spout from the stowed configuration to the dispensing configuration and disengagement from the spout cover so that the spout cover responsively moves from the stowed configuration to the dispensing configuration.

2. The drink bottle of claim 1, wherein the spout and spout cover are connected to the lid at diametrically opposed positions.

3. The drink bottle of claim 1, wherein the actuator is a latch mechanism selectively connected to the spout.

4. The drink bottle of claim 1, wherein the actuator is a user input feature.

5. The drink bottle of claim 1, wherein the spout cover is normally biased to the dispensing configuration.

6. The drink bottle of claim 5, further comprising a counterweight connected to an outer portion of the spout cover to orient a center of gravity of the spout cover offset from an axle of the spout cover.

7. The drink bottle of claim 5, further comprising a spring element including a first end contiguous with the spout cover and a second end contiguous with the lid.

8. The drink bottle of claim 1, wherein movement of the spout initiates responsive movement of the spout cover from the stowed configuration.

9. The drink bottle of claim 1, wherein movement of the spout initiates responsive movement of the spout cover from the dispensing configuration.

10. A lid configured for connection to a drink bottle, the lid comprising:

a spout and a spout cover, wherein each of the spout and the spout cover are movable in opposite directions between a stowed configuration and a dispensing configuration, and an actuator assembly movably connected to the lid, said actuator assembly operatively coupled to the spout when the spout is disposed in the stowed configuration such that the spout engages the spout cover to responsively retain the spout cover in the stowed configuration, and said actuator assembly selectively operatively uncoupled from the spout in order to facilitate movement of the spout from the stowed configuration to the dispensing configuration and disengagement from the spout cover so that the spout cover responsively moves from the stowed configuration to the dispensing configuration.

11. The lid of claim 10, wherein the spout and spout cover are connected to the lid in diametrically opposed positions.

12. The lid of claim 10, wherein the actuator is a latch mechanism selectively connected to the spout.

13. The lid of claim 10, wherein the actuator is a user input feature.

14. The lid of claim 10, wherein the spout cover is normally biased to the dispensing configuration.

15. The lid of claim 14, further comprising a counterweight connected to an outer portion of the spout cover to orient a center of gravity of the spout cover offset from an axle of the spout cover.

16. The lid of claim 14, further comprising a spring element disposed about an axle of the spout cover, the spring element including a first end contiguous with the spout cover and a second end contiguous with the lid.

17. The lid of claim 10, wherein movement of the spout initiates responsive movement of the spout cover from the stowed configuration.

18. The lid of claim 10, wherein movement of the spout initiates responsive movement of the spout cover from the dispensing configuration.

* * * * *